US007044808B1

(12) United States Patent
Foltz et al.

(10) Patent No.: US 7,044,808 B1
(45) Date of Patent: May 16, 2006

(54) CONNECTOR ASSEMBLY WITH TERMINAL POSITION ASSURANCE DEVICE

(75) Inventors: Keith R Foltz, Duncannon, PA (US); Bradley S Buchter, East Berlin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/147,090

(22) Filed: Jun. 7, 2005

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 6,599,150 B1 * 7/2003 Martin et al. ..... 439/595
6,695,651 B1 * 2/2004 Mase et al. ..... 439/752

* cited by examiner

*Primary Examiner*—Tho D. Ta

(57) ABSTRACT

A connector assembly including a housing and a TPA device. The housing is configured to receive a first terminal in a first direction, and includes a first slot, a second slot, and a first latch that is movable between a flexed position wherein the first latch is disengaged from the first terminal and an unflexed position wherein the first latch is engaged with the first terminal to inhibit movement of the first terminal in a second direction that is opposite the first direction. The TPA device is configured to be coupled to the housing for movement between a mated position and a pre-latched position, and includes a first retention block that is received by the first slot, the first retention block inhibiting the first latch from moving from the unflexed position to the flexed position when the TPA device is in the mated position, and a second retention block that is received by the second slot, the second retention block inhibiting movement of the first terminal in the second direction.

28 Claims, 16 Drawing Sheets

CONNECTOR ASSEMBLY WITH TERMINAL POSITION ASSURANCE DEVICE

FIELD OF THE INVENTION

The present invention generally relates to connector assemblies, and more particularly to a connector assembly having a plurality of terminal retention features.

BACKGROUND OF THE INVENTION

Various types of connectors must be designed to prevent disconnection of the electrical signals routed through the electrical terminals housed in the connectors. In certain automotive applications, for example, wherein electrical signals are routed to operational or safety equipment such as air bag deployment systems, ABS systems, tire pressure monitoring systems, etc., disconnection of the electrical signals may result in undesirable consequences. In such applications, manufacturers specify, among other things, pull out forces that must be withstood by electrical terminals in connector assemblies carrying signals to and/or from the equipment. Additionally, it is desirable to ensure that the terminals used in such connector assemblies be properly aligned and fully seated in the desired position.

SUMMARY OF THE INVENTION

The present invention provides, in one embodiment, a connector assembly including a housing and a terminal position assurance ("TPA") device. The housing is configured to receive a first terminal in a first direction, and includes a first slot, a second slot, and a first latch that is movable between a flexed position wherein the first latch is disengaged from the first terminal and an unflexed position wherein the first latch is engaged with the first terminal to inhibit movement of the first terminal out of its seated position in a second direction that is opposite the first direction. The TPA device is configured to be coupled to the housing for movement between a mated position and a pre-latched position, and includes a first retention block that is received by the first slot, and a second retention block that is received by the second slot. The first retention block inhibits the first latch from moving from the unflexed position to the flexed position when the TPA device is in the mated position, thereby retaining the first terminal in its seated position. The second retention block also inhibits movement of the first terminal in the second direction by engaging a rearward wall of the first terminal as the first terminal is moved out of its seated position.

The above mentioned and other features of this invention, and the manner of attaining them, will become more apparent and the invention itself will be better understood by reference to the following description of embodiments of the invention taken in conjunction with the accompanying drawings.

Figure 1A:
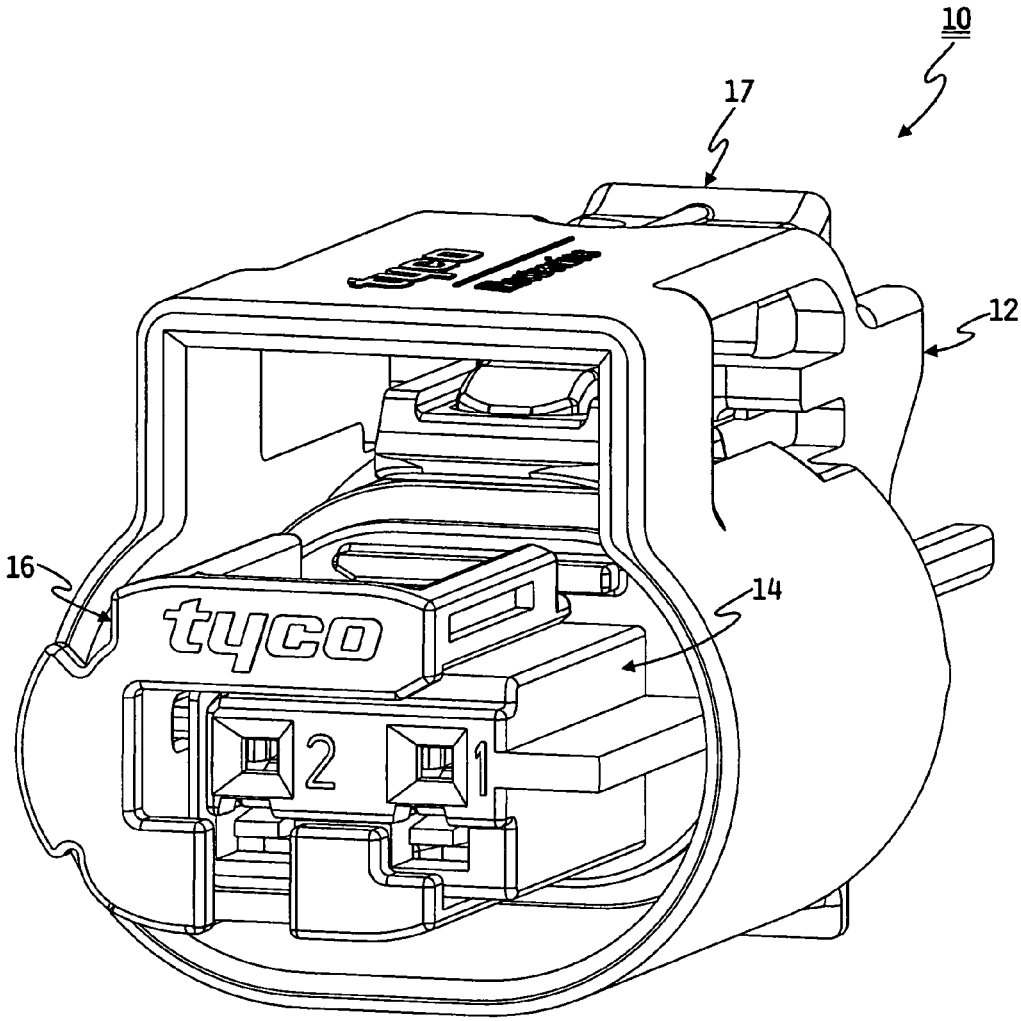
FIG. 1A is a perspective view of one embodiment of a connector assembly according to the present invention, depicting a TPA device in a pre-latched position.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF EMBODIMENTS OF THE INVENTION

The embodiments disclosed below are not intended to be exhaustive or to limit the invention to the precise forms disclosed in the following detailed description. Rather, the embodiments are chosen and described so that others skilled in the art may utilize their teachings.

Figure 1B:
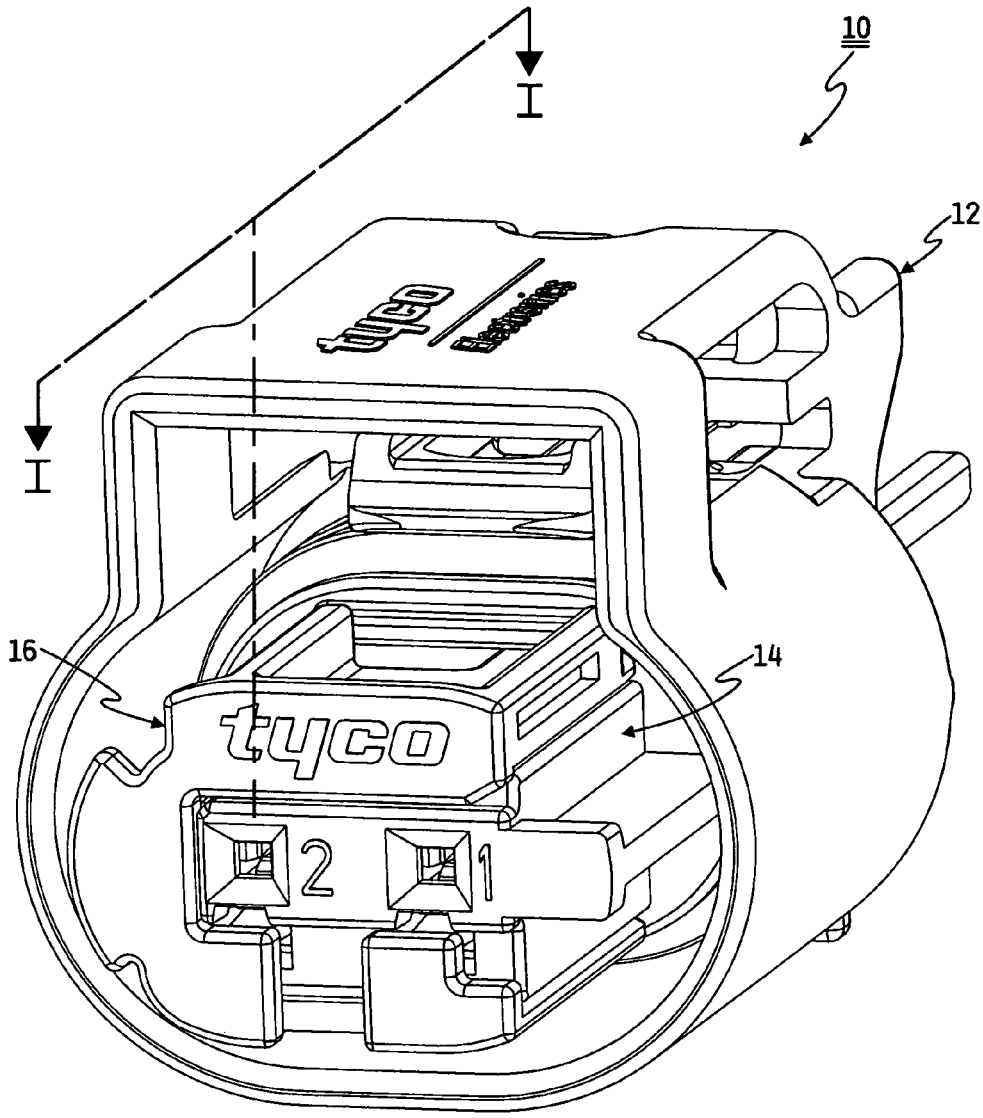
FIG. 1B is a perspective view of the connector assembly of FIG. 1, depicting the TPA device in a mated position.

Referring now to FIG. 1A, a connector assembly 10 according to one embodiment of the invention generally includes an outer housing 12, an inner housing 14, and a terminal position assurance ("TPA") device 16. As will be described in detail below, TPA device 16 is coupled to inner housing 14 for movement between a pre-latched position (as shown in FIG. 1A) and a mated position (as shown in FIG. 1B). With TPA device 16 attached, inner housing 14 is received by outer housing 12. After connector assembly 10 is assembled, a mating assembly (not shown) is connected to connector assembly 10 to form a sealed, electrical connection between terminals of assembly 10 and terminals of the mating assembly. As shown in the figures, an optional connector position assurance ("CPA") device 17 may be attached to outer housing 12 to lock the mated assemblies in mating engagement with one another.

Figure 2:
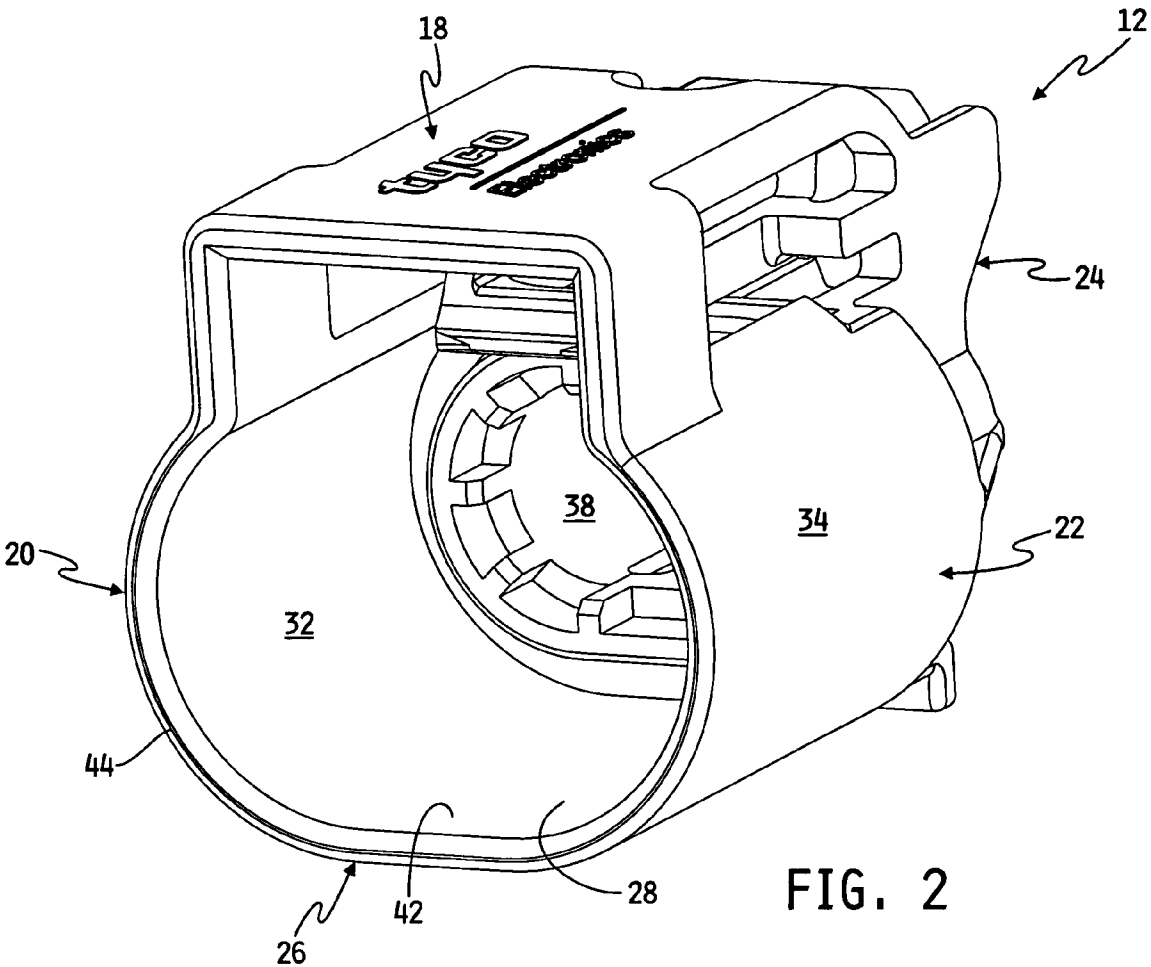
FIG. 2 is a perspective view of an outer housing of a connector assembly according to the present invention.

Outer housing 12 is shown in FIG. 2. In general, outer housing 12 includes an upper wall 18, a pair of side walls 20, 22, a rear wall 24, and a lower wall 26, which together substantially define an interior space 28. Structural components of the mating assembly (not shown) and CPA device 17 are received by a plurality of openings and structural components of upper wall 18, which will not be described in detail herein. Side wall 20 includes an outer surface (not shown) and an inner surface 32. Side wall 22 similarly includes an outer surface 34 and an inner surface (not shown). Rear wall 24 forms an opening 38 configured to receive a portion of inner housing 14 when connector assembly 10 is assembled. Lower wall 26 includes an outer surface (not shown) and an inner surface 42, and is integrally connected to side walls 20, 22. Together, upper wall 18, side walls 20, 22, and lower wall 26 form a forward edge 44 of outer housing 12. As shown, side walls 20, 22 and lower wall 26 together have a substantially "C" shaped cross-section.

Figure 3A:
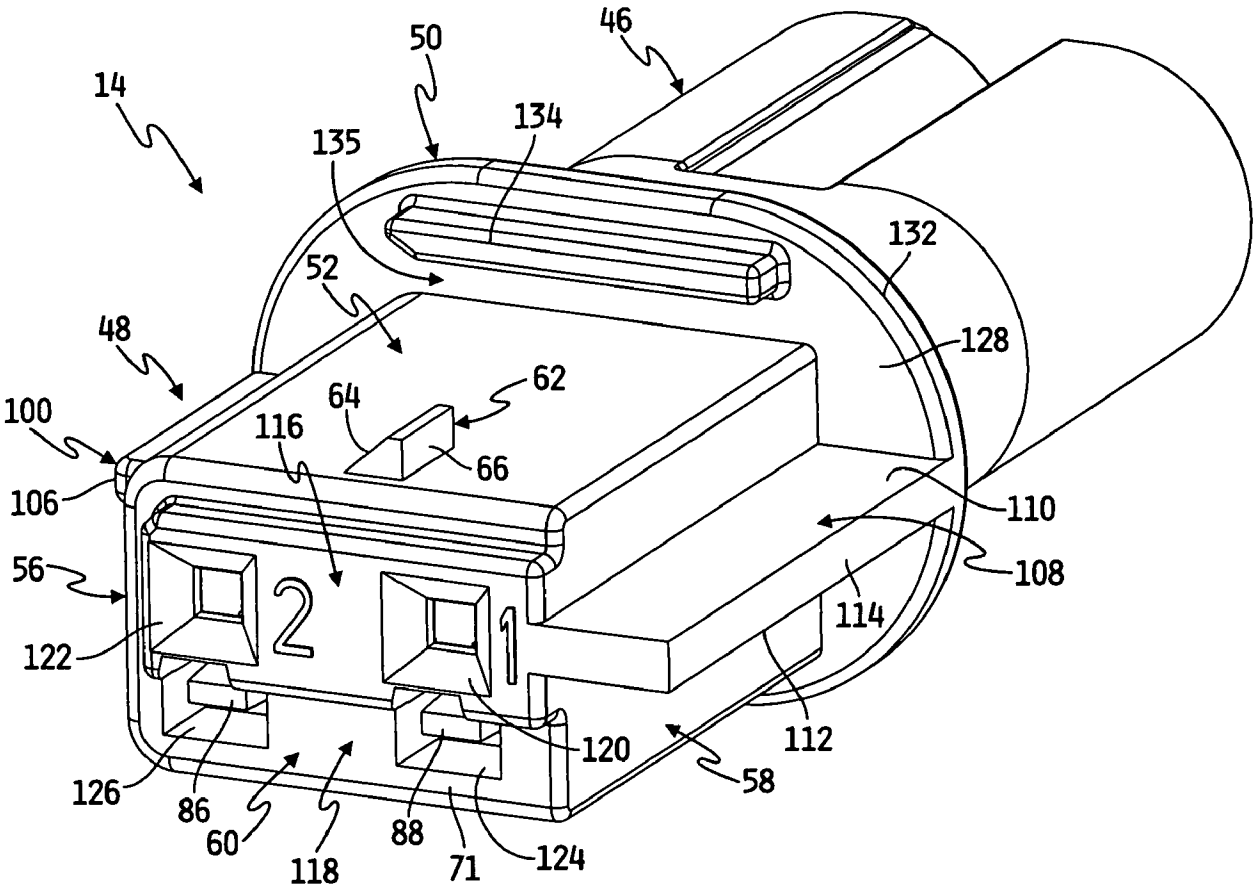
FIGS. 3A and 3B are perspective views of an inner housing according to the present invention.
Figure 3B:
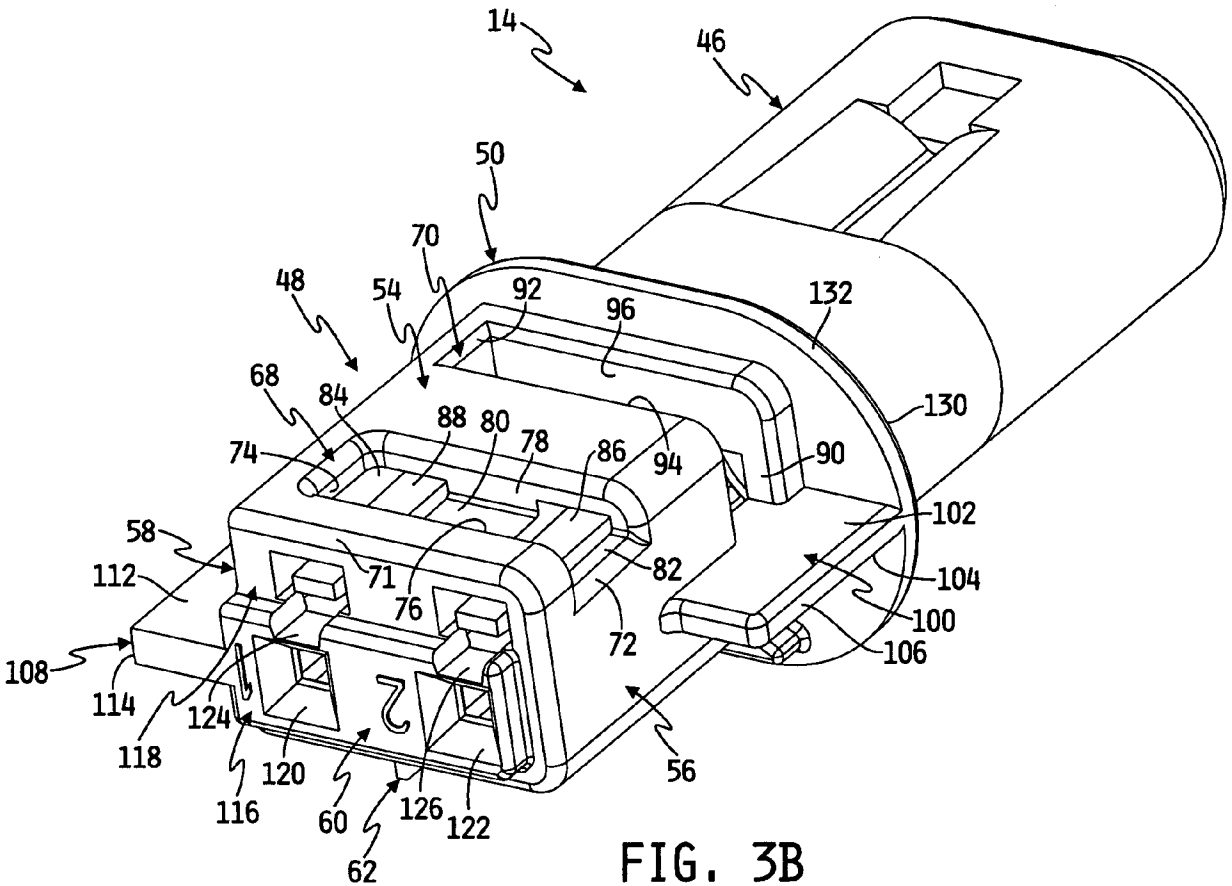

Referring now to FIGS. 3A and 3B, inner housing 14 generally includes a rear body 46, a forward body 48, connected together at a guide wall 50. Rear body 46 generally defines an interior space (not shown) through which wires connected to terminals installed in inner housing 14 extend for connection to the electronics of the application of connector assembly 10. Forward body 48 includes an upper wall 52, a lower wall 54, side walls 56, 58, and forward wall 60. Upper wall 52 includes a lug 62 having a cam surface 64 and a retention surface 66 configured to retain TPA device 16 in the pre-latched position and the mated position as will be further described below. As best shown in FIG. 3B, lower wall 54 substantially defines a first slot 68 and a second slot 70, and includes a laterally extending overstress bar 71 that limits movement of latches included in inner housing 14 as will be further described below. First slot 68 extends substantially laterally across lower wall 54 in a direction that is substantially perpendicular to a longitudinal axis of the terminals housed by inner housing 14 as is further described below. First slot 68 includes a first end 72, a second end 74, and a pair of substantially parallel side edges 76, 78 that extend between first end 72 and second end 74. A support block 80 extends between side edges 76, 78 and is integral with forward wall 60. Support block 80, upper wall 52, and side walls 56, 58 substantially define a pair of latch recesses 82, 84, each of which is accessible through first slot 68. As is further described below, a latch 86 extends from upper wall 52 through latch recess 82 and a latch 88 extends from upper wall 52 through latch recess 84. Second slot 70 includes a first end 90, a second end 92, a forward wall 94 (FIG. 8), and a rearward wall 96 that is integral with guide wall 50.

Figure 8:
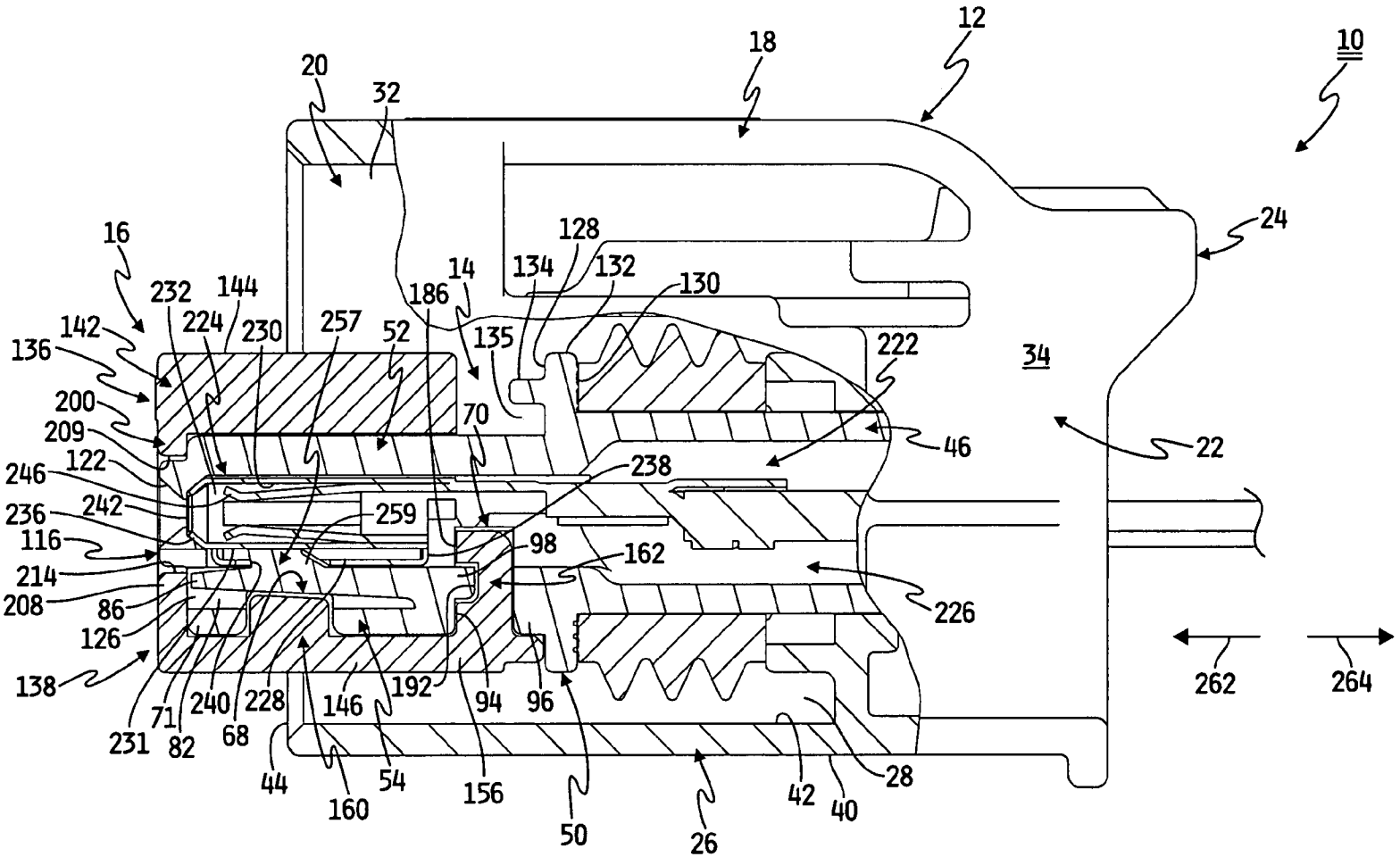
FIG. 8 is a partially fragmented cross-sectional view taken substantially along line I—I of FIG. 1B.

As indicated in FIG. 8, forward wall 94 of second slot 70 includes a guide ridge 98 configured to guide TPA device 16 onto inner housing 14 as is further described below. Extending between side wall 56 and guide wall 50 is a first rib 100 having an upper surface 102 that extends partially into second slot 70, a lower surface 104, and an edge 106. As shown, rib 100 is substantially perpendicular to both side wall 56 and guide wall 50. As best shown in FIG. 3A, a second rib 108 extends between side wall 58 and guide wall 50. Rib 108 also includes an upper surface 110, a lower surface 112, and an edge 114. As shown, rib 108 is substantially perpendicular to both side wall 58 and guide wall 50, and extends substantially the entire length of side wall 58 between guide wall 50 and forward wall 60. Forward wall 60 includes a protruding portion 116 and a recessed portion 118. Protruding portion 116 includes a first opening 120 and a second opening 122 that extend into terminal chambers as is further described below. Recessed portion 118 similarly includes a first opening 124 that extends into latch recess 84 and a second opening 126 that extends into latch recess 82.

As best shown in FIG. 3B, latch 86 extends partially through opening 126 and latch 88 extends partially through opening 124. Guide wall 50 includes a forward surface 128, a rearward surface 130, and a peripheral edge 132 that substantially corresponds to the dimensions and contours of interior space 28 of outer housing 12. Forward surface 128 includes a ridge 134 that extends substantially laterally along forward surface 128 to inhibit removal of TPA device 16 when coupled to inner housing 14 as is further described below.

Figure 4A:
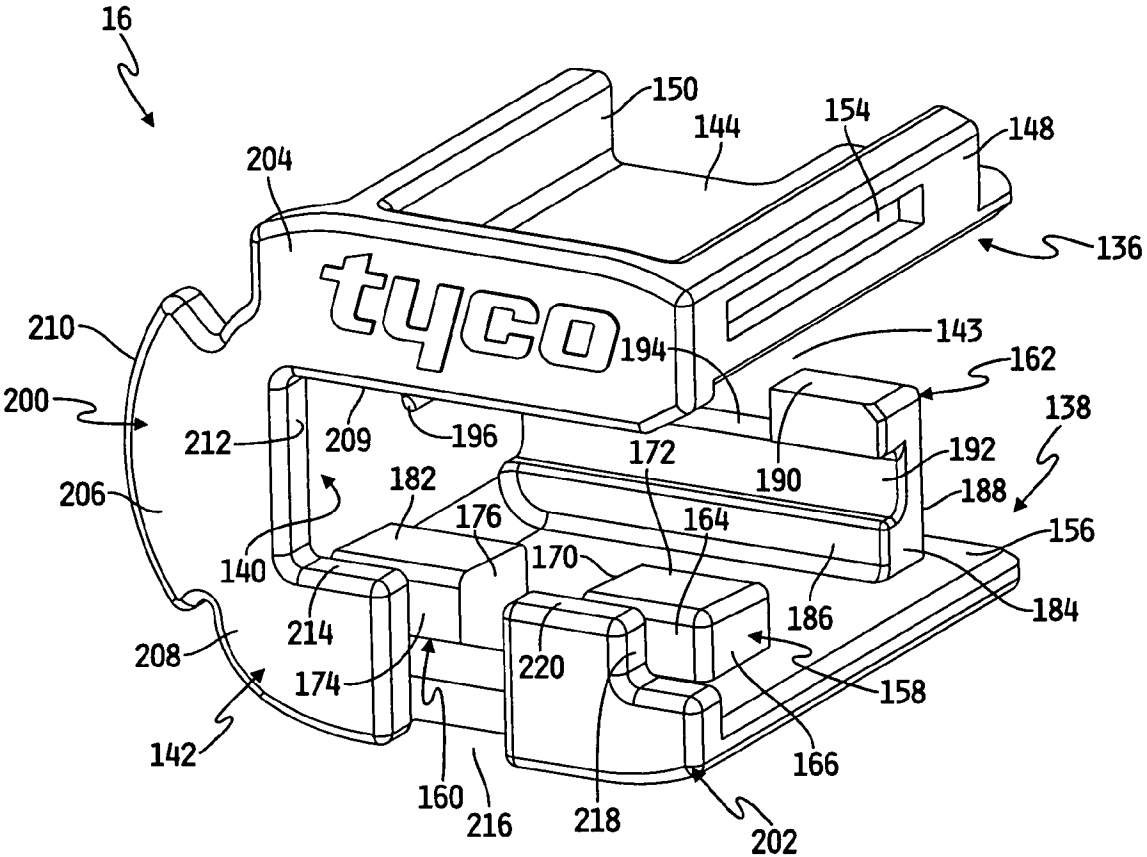
FIGS. 4A and 4B are perspective views of a TPA device according to the present invention.
Figure 4B:
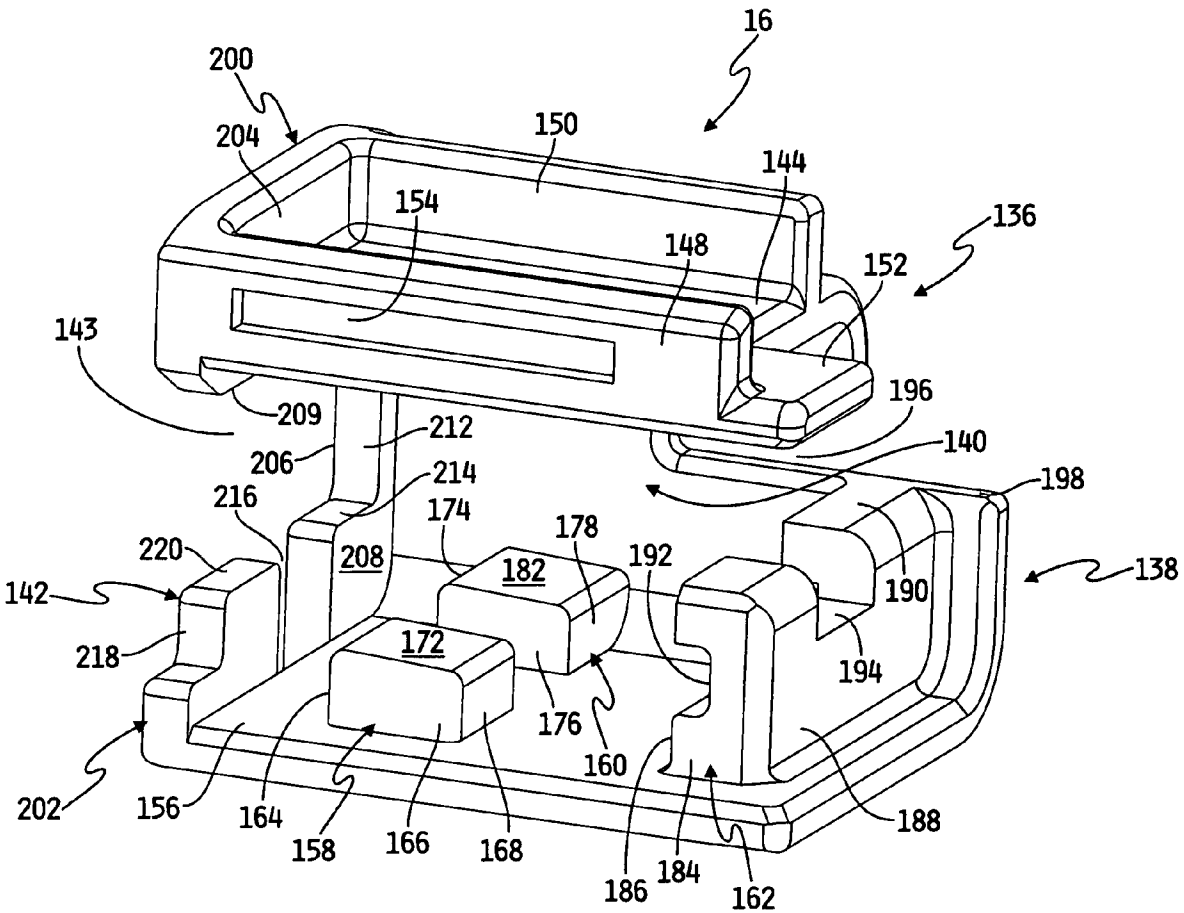

Referring now to FIGS. 4A and 4B, TPA device 16 generally includes an upper portion 136, a lower portion 138, a side wall 140 connecting upper portion 136 to lower portion 138, and a front wall 142, which together substantially define an interior space 143. Upper portion 136 includes an upper wall 144, and a pair of side walls 148, 150 extending from upper wall 144. Upper wall 144 includes a portion that extends farther rearwardly (as viewed in the figures) than side walls 148, 150 to form a ledge 152 that is received between upper wall 52 of inner housing 14 and ridge 134 during installation of TPA device 16 onto inner housing 14. Side wall 148 includes a pry slot 154 for use in removing TPA device 16 from inner housing 14 as is further described below.

Lower portion 138 of TPA device 16 includes a lower wall 156, a first retention block 158, a second retention block 162, and a third retention block 160, all extending from lower wall 156 into interior space 143. First retention block 158 includes side surfaces 164, 166, 168, 170 and upper surface 172. Third retention block 160 also includes side surfaces 174, 176, 178 and upper surface 182. As shown, a portion of third retention block 160 opposite side surface 176 is integral with side wall 140 of TPA device 16. Second retention block 162 includes a side surface 184, a forward surface 186, a rearward surface 188, and an upper surface 190. As shown, a portion of second retention block 162 opposite side surface 184 is integral with side wall 140 of TPA device 16. A groove 192 is formed in forward surface 186 and side surface 184, and extends substantially the entire length of second retention block 162. Also, a notch 194 is formed in forward surface 186, rearward surface 188, and upper surface 190.

Side wall 140 of TPA device 16 includes a cut-out 196 having a lower edge 198 that is substantially the same distance from lower wall 156 as upper surface 190 of second retention block 162.

Front wall 142 of TPA device 16 generally includes a first portion 200 and a second portion 202, both occupying substantially the same plane. First portion 200 generally includes an upper segment 204, a side segment 206 and a lower segment 208. Upper segment 204 extends between and connects upper wall 144, and side walls 148, 150 of upper portion 136, and includes a lower edge 209. Side segment 206 includes an outer edge 210 that substantially conforms to the contour of side wall 32 of outer housing 12, and an inner edge 212. Lower segment 208 is connected to lower wall 156 and includes an upper edge 214. As shown, second portion 202 of front wall 142 is spaced apart from lower segment 208 of first portion 200, thereby forming a gap 216. Second portion 202 includes a notch 218 and an upper edge 220. Edges 209, 212, 214, and 220 together substantially define a frame for receiving protruding portion 116 of inner housing 14 as is further described below.

Figure 5A:
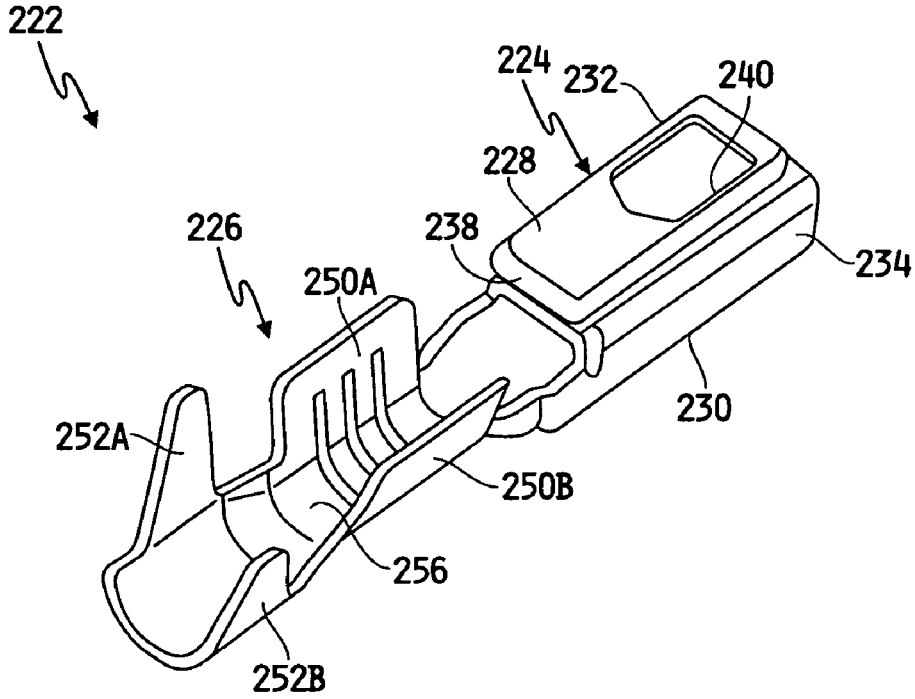
FIG. 5A is a perspective view of a terminal for use with a connector assembly according to the present invention.
Figure 5B:
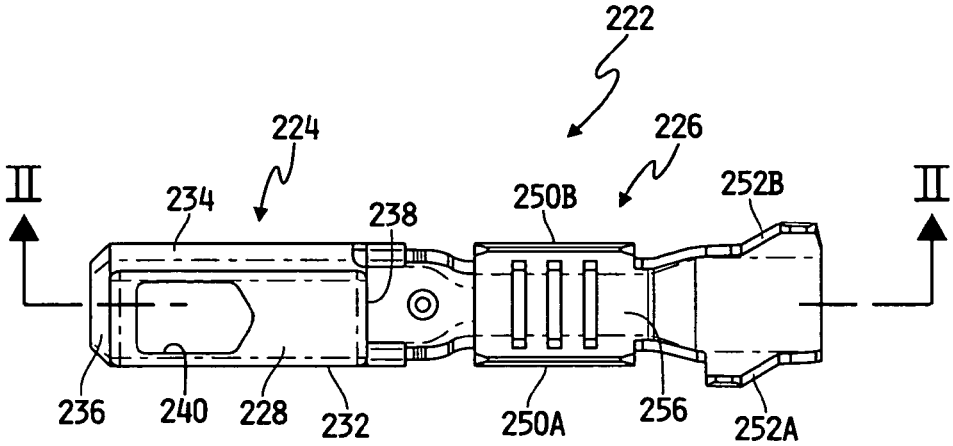
FIG. 5B is a top plan view of the terminal of FIG. 5A.
Figure 5C:
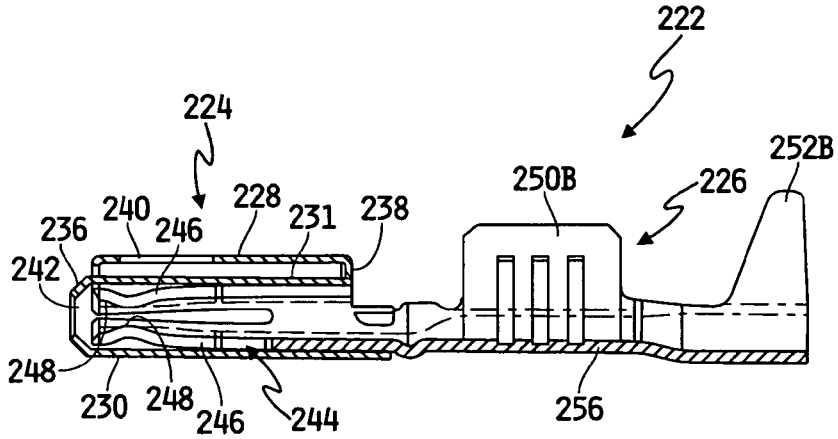
FIG. 5C is a cross-sectional view taken substantially along line II—II of FIG. 5B.

Referring now to FIGS. 5A through 5C, one embodiment of a terminal 222 for use with connector assembly 10 is shown. In this example, terminal 222 is a 0.64 mm MQS clean body terminal, but various different types of terminals may be used consistent with the teachings of the present invention. Terminal 222 generally includes a receptacle 224, and a wire portion 226. Receptacle 224 includes an upper wall 228, a lower wall 230, an inner wall 231, a pair of side walls 232, 234 extending between upper wall 228 and lower wall 230, a forward wall 236, and a rearward wall 238. As best shown in FIGS. 5A and 5B, upper wall 228 includes an aperture 240. As best shown in FIG. 5C, forward wall 236 forms an aperture 242 for receiving a mating terminal (not shown) as is further described below. Inner wall 231 extends between side walls 232, 234 in substantially parallel relationship to upper wall 228 and lower wall 230.

Wire portion 226 is made of any of a variety of conductive materials and includes a forward segment 244 (FIG. 5C) that extends into and is welded or otherwise connected to the interior surfaces of receptacle 224. Forward segment 244 includes a plurality of flexible contacts 246 having inner contact surfaces 248 that engage the exterior of the mating terminal (not shown) to provide electrical connection between terminal 222 and the mating terminal. Wire portion 226 further includes a first pair of conductor clamps 250A, 250B, and a second pair of conductor clamps 252A, 252B, all extending from a central wall 256. After a conductor placed onto central wall 256, clamps 250A, 250B are crimped toward one another, around the conductor, in a manner that is well-known in the art. Similarly, clamps 252A, 252B are crimped around the conductor. In this manner, electrical connection is made between the conductor and terminal 222.

Figure 6:
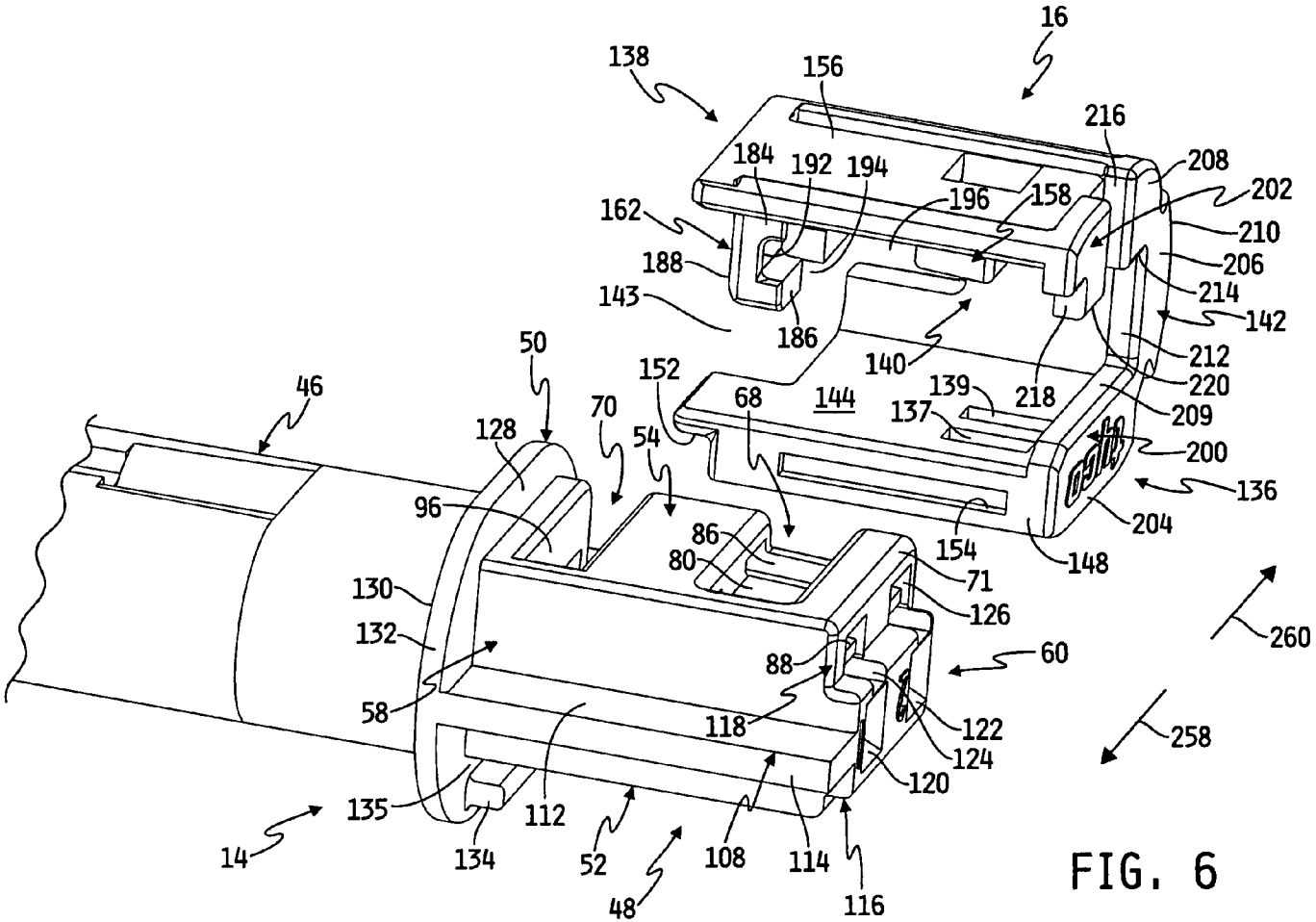
FIG. 6 is a partially fragmented perspective view of the inner housing of FIGS. 3A and 3B and the TPA device of FIGS. 4A and 4B.
Figure 7A:
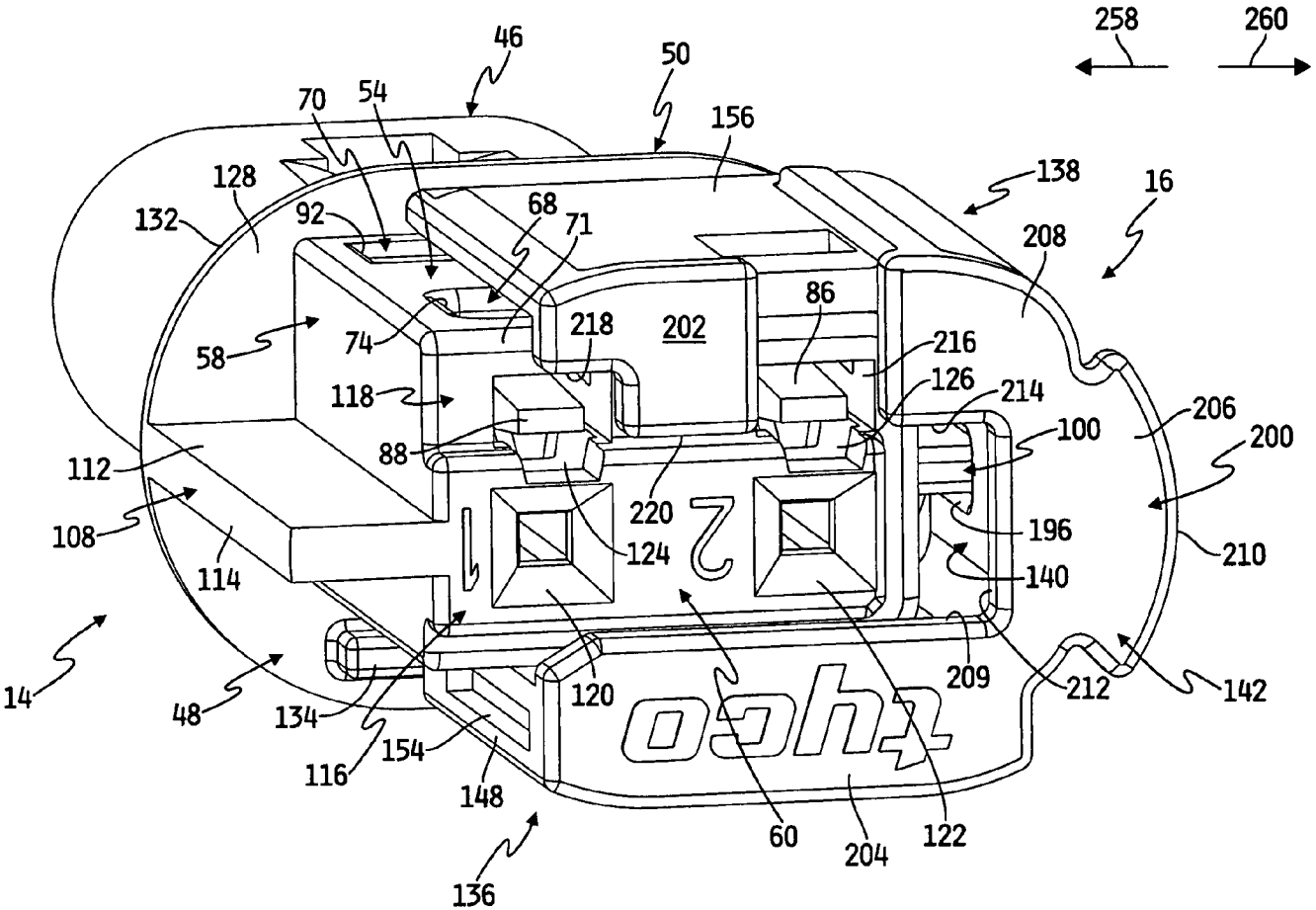
FIG. 7A is a perspective view of the TPA device of FIGS. 4A and 4B coupled to the inner housing of FIGS. 3A and 3B, and in the pre-latched position.
Figure 7B:
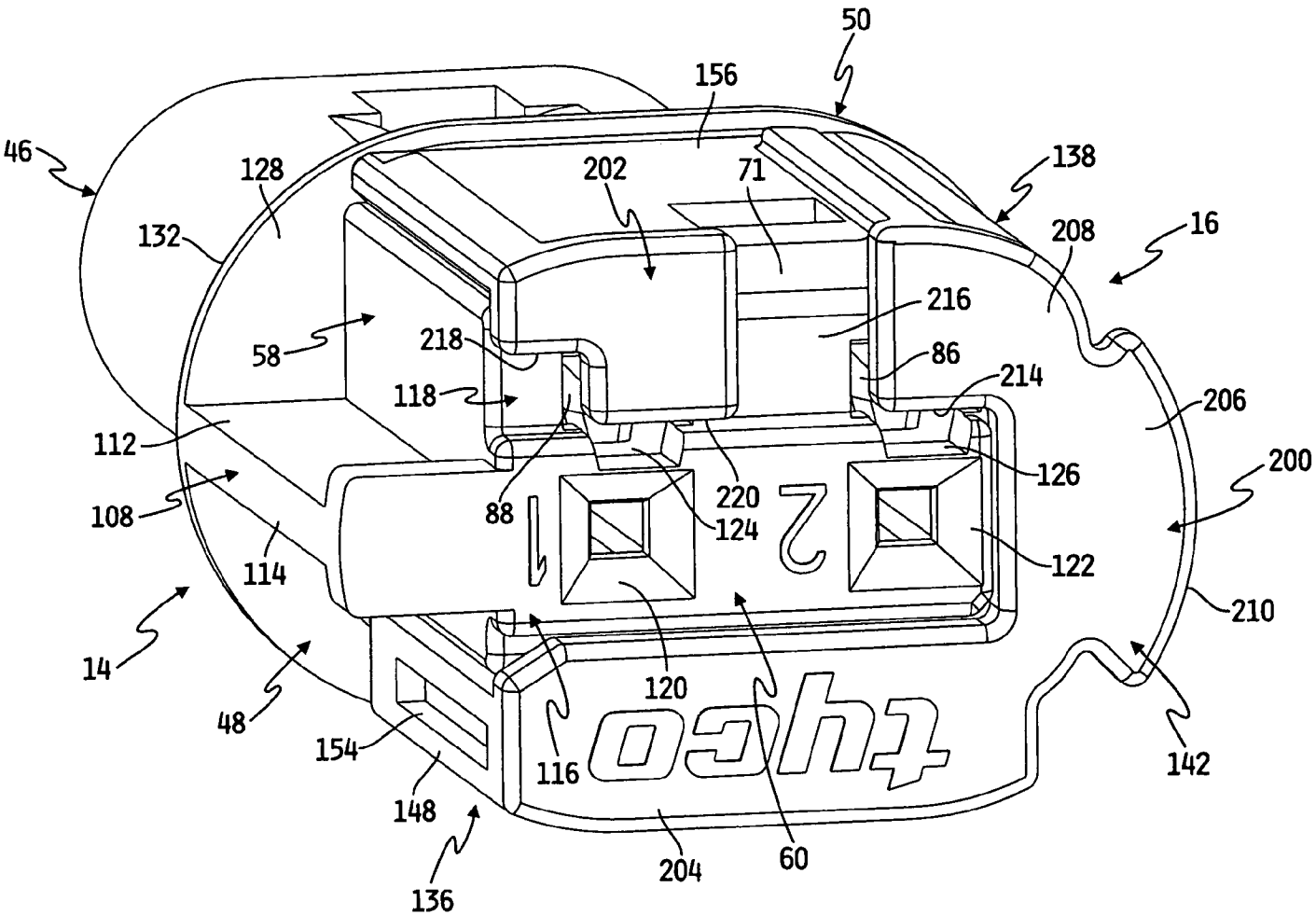
FIG. 7B is a perspective view similar to FIG. 7A, depicting the TPA device in the mated position.

Referring now to FIGS. 6 through 7B, TPA device 16 is coupled to inner housing 14 in the following manner. As shown in FIG. 6, TPA device 16 is aligned such that lower portion 138 will slide over lower wall 54 of inner housing 14 and upper portion 136 will slide over upper wall 52 of inner housing 14. More particularly, from the position shown in FIG. 6, TPA device 16 is moved axially in the direction of arrow 258 toward inner housing 14 to receive inner housing 14 substantially within interior space 143. As TPA device 16 is moved axially, first retention block 158 and third retention block 160 move into first slot 68, and second retention block 162 moves into second slot 70. Also, ledge 152 of TPA device 16 moves into a channel 135 formed between ridge 134 and upper wall 52 of inner housing 14. Additionally, the frame defined by front wall 142 of TPA device 16 partially receives protruding portion 116 of inner housing forward wall 60. Finally, groove 192 of TPA device second retention block 162 receives guide ridge 98 (FIG. 8) of forward wall 94 of inner housing second slot 70.

As TPA device 16 approaches its pre-latched position as shown in FIG. 7A, cam surface 64 of lug 62 (FIG. 3A) projecting from upper wall 52 of inner housing 14 engages upper wall 144 of TPA device 16, causing upper portion 136 to flex slightly away from lower portion 138. The clearance between ridge 134 of inner housing 14 and ledge 152 of TPA device 16 is sufficient to permit this amount of flexing, but substantially prevents excessive flexing of upper portion 136 away from inner housing 14. When TPA device 16 reaches its pre-latched position, lug 62 registers with first recess 137 formed in upper wall 144, and TPA device 16 returns to its original, un-flexed state. As should be apparent from the foregoing, when lug 62 is received by first recess 137, retention surface 66 of lug 62 substantially prevents movement of TPA device 16 in the direction of arrow 260, unless upper portion 136 of TPA device 16 is flexed away from inner housing 14 in the manner described below. As shown in FIG. 7A, when TPA device 16 is in the pre-latched position, second portion 202 of front wall 142 is positioned between first opening 124 and second opening 126 of recessed portion 118 of inner housing 14. Notch 218 provides access to first opening 124 and gap 216 provides access to second opening 126. As such, a technician may probe terminals 222 located within inner housing 14 through openings 124, 126. Also, because first retention block 158 is positioned between latches 86, 88 and third retention block 160 is positioned to the right of latch 86 as viewed in FIG. 7A, latches 86, 88 may be flexed upwardly toward overstress bar 71 out of engagement with respective terminals 222 to permit removal of the terminals through rear body 46 of inner housing 14, as will be further described below. Overstress bar 71, however, prevents excessive flexing of latches 86, 88 and the accompanying damage that may result. It should also be noted that when TPA device 16 is in the pre-latched position of FIG. 7A, second retention block 162 has not been moved sufficiently in the direction of arrow 258 to prevent removal of terminal 222 associated with latch 88 and notch 194 of second retention block 162 provides clearance for removal of terminal 222 associated with latch 86.

As TPA device 16 is moved farther in the direction of arrow 258 toward its mated position, cam surface 64 of lug 62 causes upper portion 136 of TPA device 16 to flex slightly away from inner housing 14, and lug 62 moves out of first recess 137. Eventually, lug 62 registers with second recess 139, and lower portion 138 returns to its original, unflexed state as lug 62 enters second recess 139. As such, retention surface 66 of lug 62 engages the side wall of second recess 139 and substantially inhibits movement of TPA device 16 in the direction of arrow 260. As shown in FIG. 7B, when TPA device 16 reaches the mated position, second portion 202 of front wall 142 substantially covers or obstructs access to latch 88 through opening 124. Similarly, lower segment 208 of first portion 200 substantially obstructs access to latch 86 through opening 126.

Additionally, as is described below with reference to FIG. 8, first retention block 158 substantially inhibits movement of latch 88 out of its unflexed position, and therefore disengagement from the corresponding terminal 222, and third retention block 160 substantially inhibits movement of latch 86 out of its unflexed position, and therefore disengagement from the corresponding terminal 222. Concurrently with first retention block 158 and third retention block 160, second retention block 162 substantially inhibits removal of terminals 222 by engaging rearward walls 238 of terminals 222 if terminals 222 are moved in the direction of arrow 264 of FIG. 8 as is further described below. Although not shown in the figures, it should be understood that when TPA device 16 reaches the mated position, first rib 100 of inner housing 14 (FIG. 3B) extends through cut-out 196 of TPA device side wall 140 (FIG. 6).

Referring now to FIG. 8, which is a cross-sectional view taken substantially along line I—I of FIG. 1B, TPA device 16 is in the mated position, and the TPA device 16/inner housing 14 assembly is installed in outer housing 12. Additionally, terminal 222 is installed in inner housing 14. This figure most clearly depicts the retention features provided by first retention block 158, second retention block 162, and third retention block 160. Terminal 222 is installed in inner housing 14 by urging terminal 222 in the direction of arrow 262 though rear body 46 and into forward body 48. This installation is performed with TPA device 16 coupled to inner housing 14 in the pre-latched position. As terminal 222 enters forward body 48, receptacle 224 of terminal 222 engages a lug 257 extending from latch 86, causing latch 86 to deflect downwardly as viewed in the figure into latch recess 82. When terminal 222 reaches the position shown in FIG. 8, latch 86 returns to its unflexed position, and lug 257 enters aperture 240 (FIG. 5B) of receptacle upper wall 228. As such, lug 257 ensures proper location of terminal 222 and inhibits movement of terminal 222 in the direction of arrow 264 by engagement with the edge of aperture 240. Sufficient force, however, would tend to deform or flex latch 86 out of engagement with receptacle 224. As shown, when TPA device 16 is moved to its mated position, third retention block 160 is positioned in first slot 68 directly below (as viewed in the figure) latch 86 and lug 257. Accordingly, third retention block 160 substantially prevents such flexing of latch 86 in a downward direction.

Additionally, second retention block 162 inhibits movement of terminal 222 in the direction of arrow 264. More specifically, second retention block 162 is positioned in second slot 70 such that forward surface 186 is positioned directly behind (as viewed in the figure) rearward wall 238 of terminal 222. Thus, forward surface 186 would engage rearward wall 238 if sufficient force is applied to terminal 222, thereby substantially preventing removal of terminal 222 in the direction of arrow 264. It should be understood, of course, that first retention block 158 (FIG. 4B) interacts with latch 88, and second retention block 162 interacts with the corresponding terminal 222 (not shown) in a similar fashion.

It should be further understood that if terminal 222 were not fully seated in the position shown in FIG. 8, TPA device 16 would not be movable to its mated position. More specifically, if forward wall 236 of receptacle 224 were spaced apart from opening 122, lug 257 would not register with aperture 240. As such, latch 86 would be flexed downwardly. Consequently, TPA device 16 could not be moved to its mated position because third retention block 160 would engage latch 86, which would prevent further movement of TPA device 16. TPA device 16, therefore, provides a mechanism for detecting partially inserted terminals 222.

Figure 9A:
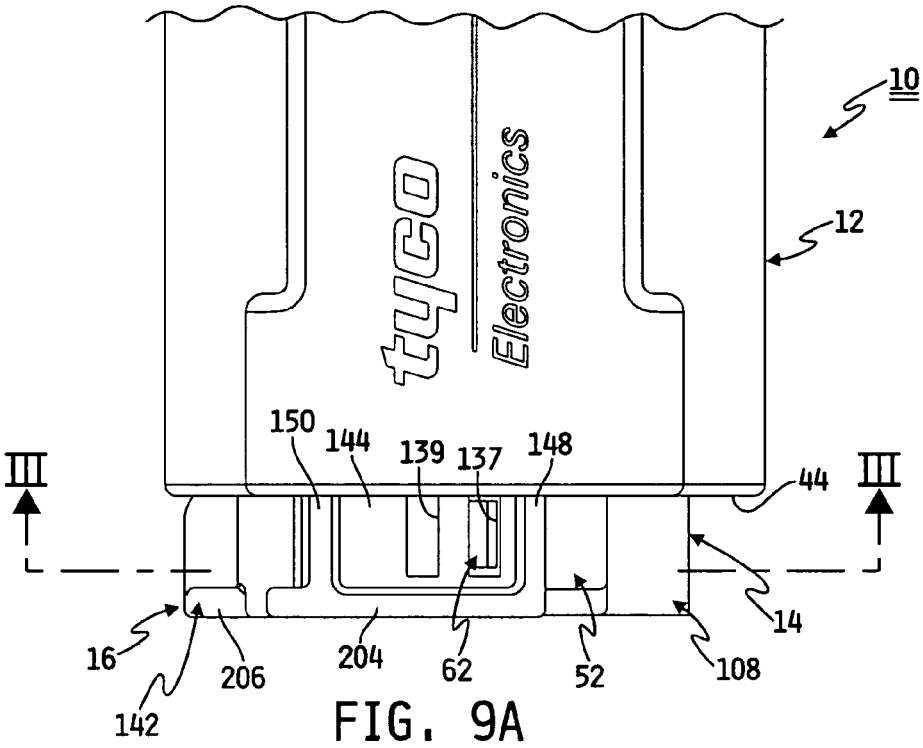
FIG. 9A is a partially fragmented top plan view of the connector assembly of FIG. 1B.
Figure 9B:
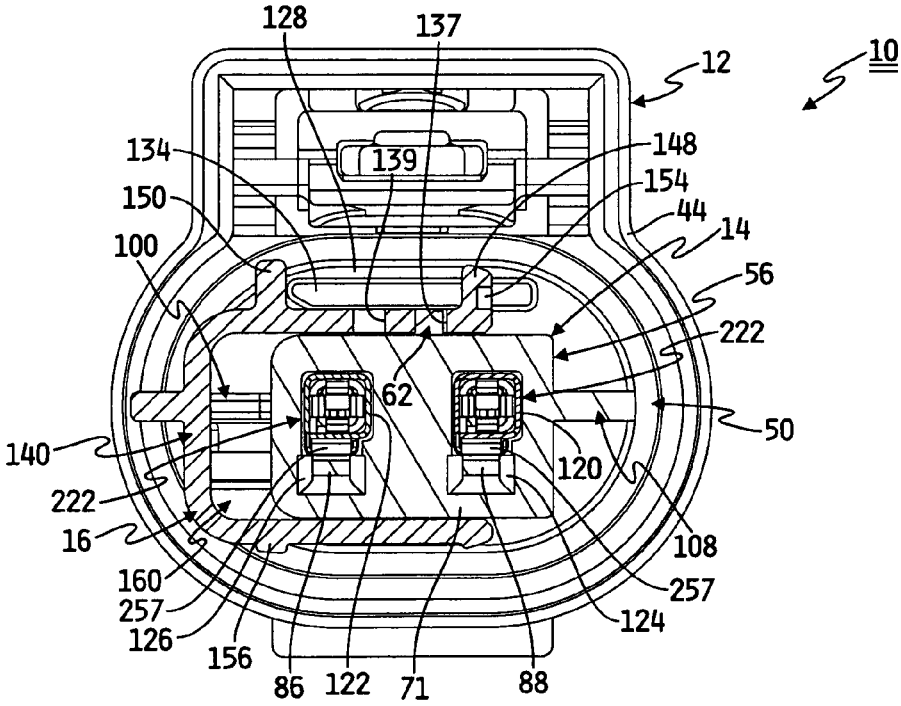
FIG. 9B is a cross-sectional view taken substantially along line III—III of FIG. 9A, depicting the TPA device in the pre-latched position.

FIGS. 9A through 11B further depict the various features of connector assembly 10. As shown in FIGS. 9A and 9B, TPA device 16 and inner housing 14 are installed in outer housing 12. TPA device 16 is coupled to inner housing 14, but shown in the pre-latched position. Cross-section line III—III is taken through TPA device 16 between front wall 142 and first and third retention blocks 158, 160. As shown in FIG. 9B, lug 257 of latch 86 is positioned in aperture 240 (not shown) of terminal 222 associated with second opening 122, and lug 257 of latch 88 is positioned in aperture 240 (not shown) of terminal 222 associated with first opening 120. Additionally, third retention block 160 is not positioned under latch 86 and first retention block 158 (not shown) is not positioned under latch 88. Lug 62 of inner housing 14 is shown within first recess 137. FIG. 9A further shows overstress bar 71 extending below latches 86, 88 to limit the extent of downward flexing of latches 86, 88.

Figure 10A:
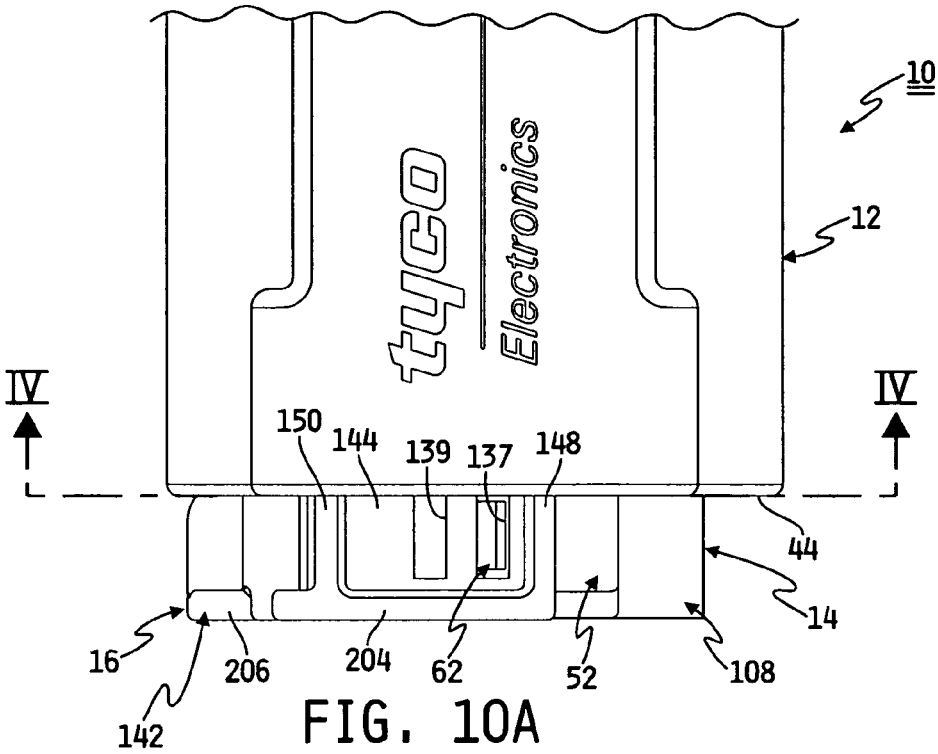
FIG. 10A is another partially fragmented top plan view of the connector assembly of FIG. 1B.
Figure 10B:
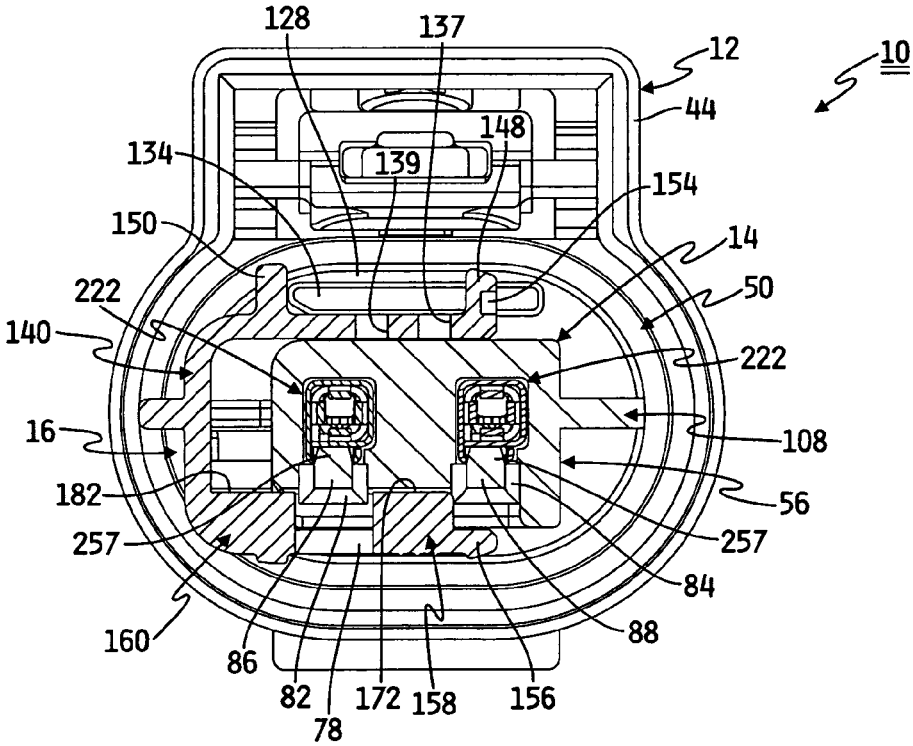
FIG. 10B is a cross-sectional view taken substantially along line IV—IV of FIG. 10A, depicting the TPA device in the pre-latched position.

FIGS. 10A and 10B also depict TPA device 16 in its pre-latched position coupled to inner housing 14. In these figures, however, cross-section line IV—IV is taken through TPA device 16 such that it substantially bisects first and third retention blocks 158, 160. As shown in FIG. 10B, first retention block 158 is not yet positioned under latch 88, and third retention block 160 is not yet positioned under latch 86.

Figure 11A:
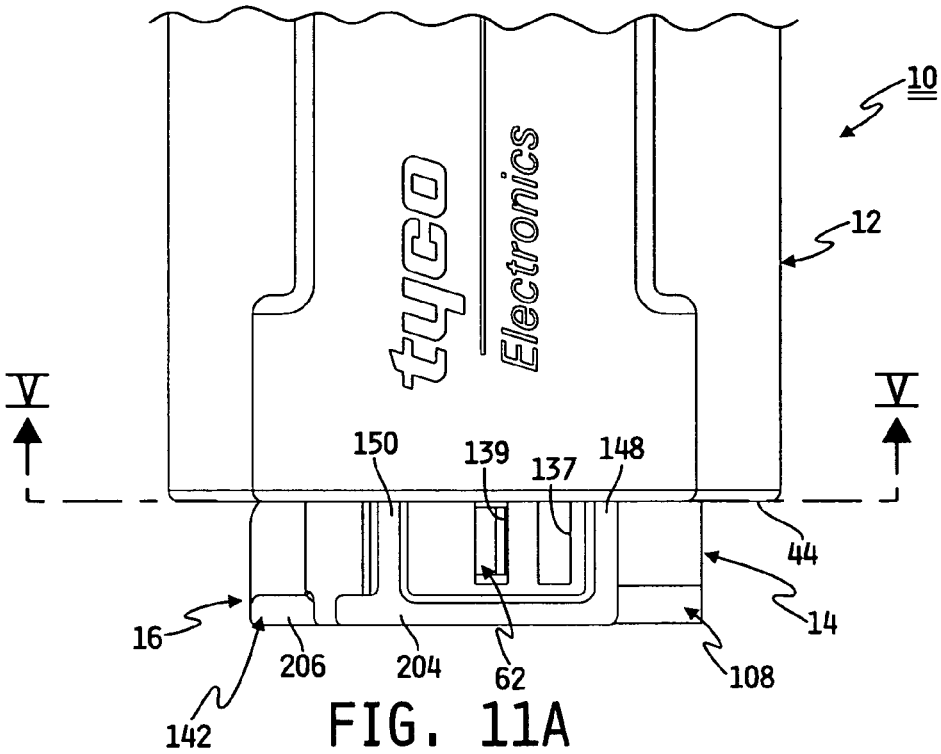
FIG. 11A is a partially fragmented top plan view of the connector assembly of FIG. 1A.
Figure 11B:
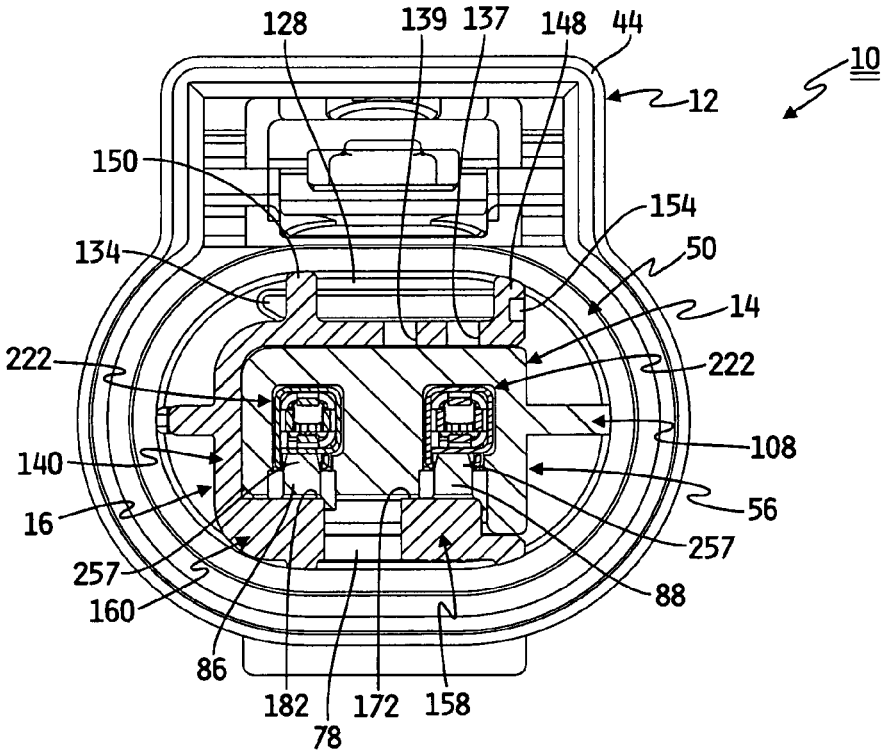
FIG. 11B is a cross-sectional view taken substantially along line V—V of FIG. 11A, depicting the TPA device in the mated position.

In FIGS. 11A and 11B, however, TPA device 16 is depicted in its mated position. Cross-section line V—V is taken at the same location as line IV—IV of FIGS. 10A and 10B. As shown, first retention block 158 is positioned under latch 88 and third retention block 160 is positioned under latch 86. As such, latches 86, 88 are substantially inhibited from flexing downwardly as viewed in the figures. Consequently, lugs 257 of latches 86, 88 remain within apertures 240 (not shown) of terminals 222 to prevent movement of terminals 222. At the same time, second retention block 162 (not shown) is positioned behind wall 238 (not shown) of terminals 222 to inhibit removal of terminals 222 as described above in reference to FIG. 8.

Terminals 222 may be removed from inner housing 14 by first moving TPA device 16 to its pre-latched position as shown in FIG. 1A. As best shown in FIGS. 7A and 7B, a technician may insert a tool into pry slot 154 of side wall 148 of TPA upper portion 136 and urge upper portion 136 slightly away (downwardly as viewed in the figures) from inner housing 14. By doing so, upper portion 136 is moved sufficiently away from upper wall 52 of inner housing 14 that lug 62 (FIG. 3A) is withdrawn from second recess 139 (FIG. 6) of TPA upper wall 144. TPA device 16 may then be shifted in the direction of arrow 260 until lug 62 registers with first recess 137. TPA device 16 may then be permitted to return to its original, unflexed state such that lug 62 enters first recess 137, thereby retaining TPA device 16 in its pre-latched position as shown in FIGS. 1A and 7B. As explained above, when TPA device 16 is in the pre-latched position, latches 86, 88 may flex away from terminals 222 such that lugs 257 of latches 86, 88 withdraw from apertures 240 of terminal receptacles 224. This flexing can occur as first retention block 158 is no longer positioned under latch 88 and third retention block 160 is no longer positioned under latch 86.

Also, when TPA device 16 is in the pre-latched position, front wall 142 no longer obstructs access to first opening 124 or second opening 126. Accordingly, a technician may insert a tool into openings 124, 126 to flex the respective latches 88, 86 out of engagement with terminals 222. Finally, the technician may pull terminals 222 in the direction of arrow 264 (FIG. 8) to remove them. This movement of terminals 222 is no longer prevented by second retention block 162 because when TPA device 16 is in the pre-latched position, forward surface 186 of second retention block 162 is not positioned behind the terminal 222 corresponding to first opening 120 and notch 194 is positioned behind the terminal 222 corresponding to second opening 122.

While the present invention as been described as including structure to accommodate two terminals 222, it should be understood that the principles of the present invention may readily be applied to connector assemblies having more or fewer than two terminals 222.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A connector assembly, including:

a housing configured to receive a first terminal in a first direction, the housing including a first slot, a second slot separate from the first slot, and a first latch that is movable between a flexed position wherein the first latch is disengaged from the first terminal and an unflexed position wherein the first latch is engaged with the first terminal to inhibit movement of the first terminal in a second direction that is opposite the first direction; and a TPA device configured to be coupled to the housing for movement between a mated position and a pre-latched position, the TPA device including a first retention block that is received by the first slot, the first retention block inhibiting the first latch from moving from the unflexed position to the flexed position when the TPA device is in the mated position, and a second retention block that is received by the second slot, the second retention block inhibiting movement of the first terminal in the second direction.

2. The connector assembly of claim 1 wherein the first latch is a cantilever latch that extends within a recess formed in the housing.

3. The connector assembly of claim 1 wherein the housing includes a guide ridge that extends into the second slot and the second retention block includes a groove that receives the guide ridge as the TPA device is moved between the mated position and the pre-latched position.

4. The connector assembly of claim 1 wherein the first latch includes a lug that extends into an aperture formed in the first terminal when the first latch is in the unflexed position.

5. The connector assembly of claim 1 further including an outer housing having an interior space that receives the housing and the TPA device.

6. The connector assembly of claim 5 wherein the housing includes a guide wall having a peripheral edge that substantially corresponds to a cross-section of the interior space.

7. The connector assembly of claim 6 wherein the housing includes an upper wall and the guide wall includes a ridge, a portion of the TPA device being positioned between the upper wall and the ridge when the TPA device is in the mated position and when the TPA device is in the pre-latched position.

8. The connector assembly of claim 1 wherein the TPA device includes an upper portion, a lower portion, and a side wall extending between the upper portion and the lower portion, which together substantially define an interior space that receives a portion of the housing when the TPA device is coupled to the housing.

9. The connector assembly of claim 8 wherein the first and the second retention blocks extend from the lower portion into the interior space.

10. The connector assembly of claim 1 wherein the housing is configured to receive a second terminal in the first direction and includes a second latch that is movable between a flexed position wherein the second latch is disengaged from the second terminal and an unflexed position wherein the second latch is engaged with the second terminal to inhibit movement of the second terminal in the second direction.

11. The connector assembly of claim 10 wherein the second retention block further inhibits movement of the second terminal in the second direction when the TPA device is in the mated position.

12. The connector assembly of claim 10 wherein the housing includes a first opening that permits access to the first latch and a second opening that permits access to the second latch, the TPA device including a front wall that substantially obstructs access to the first and the second openings when the TPA device is in the mated position and does not obstruct access to the first and the second openings when the TPA device is in the pre-latched position.

13. The connector assembly of claim 10 wherein the second retention block includes a forward surface that is positioned to engage a rearward wall of each of the first terminal and the second terminal if the terminals are moved in the second direction when the TPA device is in the mated position.

14. The connector assembly of claim 10 wherein the TPA device includes a third retention block that is received by the first slot, the third retention block inhibiting the second latch from moving from the unflexed position to the flexed position when the TPA device is in the mated position.

15. The connector assembly of claim 14 wherein the first retention block is positioned substantially between the first latch and the second latch when the TPA device is in the pre-latched position.

16. The connector assembly of claim 15 wherein the second retention block includes a notch that permits removal of the first terminal in the second direction when the TPA device is in the pre-latched position.

17. A connector assembly, including:

a housing having an upper wall, a lower wall, a first side wall, a second side wall, a forward wall which together define a first cavity that receives a first terminal when inserted into the housing in a first direction, a first slot, and a second slot separate from the first slot, both slots being formed in the lower wall and extending laterally from the first side wall toward the second side wall, the second slot extending into the first cavity; and a TPA device including an upper portion, a lower portion, and a side wall extending between the upper and lower portions, the upper portion, the lower portion, and the side wall substantially defining an interior space configured to receive a portion of the housing, the lower portion including a first retention block that extends into the interior space toward the upper portion, and a second retention block that extends into the interior space toward the upper portion;

wherein the TPA device is coupled to the housing with the first retention block positioned within the first slot and the second retention block positioned within the second slot, and is movable between a pre-latched position wherein the first and the second retention blocks do not inhibit movement of the first terminal, and a mated position wherein the first and the second retention blocks inhibit movement of the first terminal in a second direction that is substantially opposite the first direction.

18. The connector assembly of claim 17 wherein the housing includes a first latch that is movable between a flexed position and an unflexed position wherein the first latch engages the first terminal to inhibit movement of the first terminal in the second direction.

19. The connector assembly of claim 18 wherein the first retention block is positioned to inhibit movement of the first latch from the unflexed position to the flexed position when the TPA device is in the mated position.

20. The connector assembly of claim 18 wherein the housing includes an overstress bar to prevent movement of the first latch beyond the flexed position.

21. The connector assembly of claim 17 wherein the housing upper wall, lower wall, first side wall, second side wall, and forward wall together define a second cavity that receives a second terminal when inserted into the housing in the first direction.

22. The connector assembly of claim 21 wherein the housing includes a first latch that is movable between a flexed position and an unflexed position wherein the first latch engages the first terminal to inhibit movement of the first terminal in the second direction, and a second latch that is movable between a flexed position and an unflexed position wherein the second latch engages the second terminal to inhibit movement of the second terminal in the second direction.

23. The connector assembly of claim 22 wherein the TPA device includes a third retention block that is received by the first slot, the third retention block inhibiting the second latch from moving from the unflexed position to the flexed position when the TPA device is in the mated position.

24. The connector assembly of claim 22 wherein the second retention block further inhibits movement of the second terminal in the second direction when the TPA device is in the mated position.

25. A connector assembly, including:

means for mating with another connector assembly;

means for housing a removable terminal, including means for latching the terminal in a seated position; and means coupled to the housing means for assuring a position of the removable terminal, including first means for retaining the terminal in a seated position, and second means separate from the first means for retaining the terminal in a seated position, the assuring means being movable on the housing means between a mated position and a pre-latched position;

wherein the first retaining means inhibits movement of the latching means and the second retaining means inhibits movement of the terminal out of the seated position when the assuring means is in the mated position.

26. A connector assembly, including:

a housing configured to receive a first terminal in a first direction, the housing including a first slot, a second slot, and a first latch that is movable between a flexed position wherein the first latch is disengaged from the first terminal and an unflexed position wherein the first latch is engaged with the first terminal to inhibit movement of the first terminal in a second direction that is opposite the first direction;

a TPA device configured to be coupled to the housing for movement between a mated position and a pre-latched position, the TPA device including a first retention block that is received by the first slot, the first retention block inhibiting the first latch from moving from the unflexed position to the flexed position when the TPA device is in the mated position, and a second retention block that is received by the second slot, the second retention block inhibiting movement of the first terminal in the second direction; and an outer housing having an interior space that receives the housing and the TPA device.

27. A connector assembly, including:

a housing configured to receive a first terminal in a first direction, the housing including a first slot, a second slot, and a first latch that is movable between a flexed position wherein the first latch is disengaged from the first terminal and an unflexed position wherein the first latch is engaged with the first terminal to inhibit movement of the first terminal in a second direction that is opposite the first direction; and a TPA device configured to be coupled to the housing for movement between a mated position and a pre-latched position, the TPA device including a first retention block that is received by the first slot, the first retention block inhibiting the first latch from moving from the unflexed position to the flexed position when the TPA device is in the mated position;

a second retention block that is received by the second slot, the second retention block inhibiting movement of the first terminal in the second direction; and a first recess and a second recess, the housing including a lug that is received by the first recess when the TPA device is in the pre-latched position and is received by the second recess when the TPA device is in the mated position.

28. A connector assembly, including:

a housing configured to receive a first terminal in a first direction, the housing including a first slot, a second slot, a first latch that is movable between a flexed position wherein the first latch is disengaged from the first terminal and an unflexed position wherein the first latch is engaged with the first terminal to inhibit movement of the first terminal in a second direction that is opposite the first direction, and an overstress bar positioned to prevent movement of the first latch beyond the flexed position; and a TPA device configured to be coupled to the housing for movement between a mated position and a pre-latched position, the TPA device including a first retention block that is received by the first slot, the first retention block inhibiting the first latch from moving from the unflexed position to the flexed position when the TPA device is in the mated position, and a second retention block that is received by the second slot, the second retention block inhibiting movement of the first terminal in the second direction.

* * * * *